US012590580B2

(12) United States Patent
Gerges

(10) Patent No.: US 12,590,580 B2
(45) Date of Patent: Mar. 31, 2026

(54) PUMP MOUNTING FLANGE

(71) Applicant: Caterpillar Inc., Peoria, IL (US)

(72) Inventor: Raymond B. Gerges, New Lenox, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/897,389

(22) Filed: Sep. 26, 2024

(65) Prior Publication Data

US 2026/0085680 A1 Mar. 26, 2026

(51) Int. Cl.
*F04B 53/16* (2006.01)
*F04B 1/2064* (2020.01)

(52) U.S. Cl.
CPC ..... *F04B 53/16* (2013.01); *F04B 1/2064* (2013.01)

(58) Field of Classification Search
CPC ..... F04B 53/16; F04B 1/2064
See application file for complete search history.

(56) References Cited

U.S. PATENT DOCUMENTS 2,439,241 A 4/1948 Curtis et al.
2,965,040 A 12/1960 James
3,407,742 A 10/1968 Mitchell et al.
3,787,014 A 1/1974 Story et al.
3,817,665 A 6/1974 Myers
4,023,836 A 5/1977 Applehans
4,184,329 A * 1/1980 Ruesch ..... F01N 13/1805 60/322
4,225,186 A 9/1980 Stratton
4,501,536 A 2/1985 Middlekauff
4,586,885 A 5/1986 Middlekauff
4,601,378 A 7/1986 Pierce et al.
(Continued)

FOREIGN PATENT DOCUMENTS

AU 2022218668 A1 9/2023
AU 2022218923 A1 9/2023
(Continued)

OTHER PUBLICATIONS

"U.S. Appl. No. 17/393,685, Non Final Office Action mailed Mar. 15, 2023", 34 pgs.
(Continued)

*Primary Examiner* — Jesse S Bogue
(74) *Attorney, Agent, or Firm* — Schwegman Lundberg & Woessner, P.A.

(57) ABSTRACT

A pump or fluid-powered motor may include a housing defining an inlet and an outlet, internal pump components arranged within the housing and operably coupled to a drive shaft having a mechanical coupling mechanism adapted to engage a corresponding mechanical drive mechanism at a mount location. A flange may be secured to the housing and adapted for securing the pump to the mount location and may include a rectangular plate having a through bore and a substantially cylindrical pilot extending therefrom, defining a first diameter, and including a peripheral groove. The flange may also include a plurality of bolt holes extending through the rectangular plate and arranged on a bolt circle with a second diameter. The second diameter may be approximately 240 mm and a distance from a top pair of the bolt holes to a bottom edge of the rectangular plate may be approximately 200 mm.

17 Claims, 7 Drawing Sheets

(56) References Cited

U.S. PATENT DOCUMENTS

| | | | | |
|---|---|---|---|---|
| 5,018,397 | A | 5/1991 | Matich | |
| 5,423,183 | A | 6/1995 | Folsom | |
| 5,645,343 | A | 7/1997 | Rinehimer | |
| 5,645,363 | A | 7/1997 | Dafforn et al. | |
| 5,829,794 | A * | 11/1998 | Schulz-Hausmann | F16L 41/08 285/212 |
| 5,847,471 | A | 12/1998 | Morishita et al. | |
| 6,158,302 | A | 12/2000 | Becker et al. | |
| 6,345,968 | B1 | 2/2002 | Shupe | |
| 6,398,521 | B1 | 6/2002 | Yorulmazoglu | |
| 6,406,271 | B1 | 6/2002 | Valentin | |
| 6,481,388 | B1 | 11/2002 | Yamamoto | |
| 6,526,748 | B1 | 3/2003 | Trimble | |
| 6,688,858 | B1 * | 2/2004 | Boone | F04B 1/2064 417/269 |
| 6,742,816 | B2 | 6/2004 | Rocheleau | |
| 6,896,491 | B2 | 5/2005 | Trubnikov et al. | |
| 7,635,255 | B2 | 12/2009 | Gleasman et al. | |
| 7,695,252 | B2 | 4/2010 | Sakikawa | |
| 10,145,396 | B2 | 12/2018 | Du et al. | |
| 10,611,232 | B2 | 4/2020 | Tigue et al. | |
| 10,760,557 | B1 * | 9/2020 | Babcock | F04B 1/053 |
| 11,168,772 | B2 | 11/2021 | Mathers | |
| 11,255,193 | B2 | 2/2022 | Mathers | |
| 11,787,275 | B2 * | 10/2023 | Watt | B60K 25/06 60/419 |
| 11,965,445 | B1 * | 4/2024 | Oshima | F01N 13/10 |
| 2004/0109626 | A1 | 6/2004 | Trubnikov et al. | |
| 2004/0226617 | A1 | 11/2004 | Arentsen et al. | |
| 2006/0213364 | A1 * | 9/2006 | Cox | F04B 1/145 91/499 |
| 2009/0056123 | A1 | 3/2009 | Phillips et al. | |
| 2009/0280021 | A1 | 11/2009 | Mathers | |
| 2012/0034121 | A1 | 2/2012 | Hicks | |
| 2012/0275928 | A1 | 11/2012 | Fritz et al. | |
| 2016/0039277 | A1 | 2/2016 | Falls et al. | |
| 2016/0084321 | A1 | 3/2016 | Mihajlovic et al. | |
| 2017/0191499 | A1 | 7/2017 | Chrabascz et al. | |
| 2018/0162370 | A1 | 6/2018 | Colavincenzo et al. | |
| 2018/0162382 | A1 | 6/2018 | Colavincenzo et al. | |
| 2020/0070644 | A1 | 3/2020 | Tigue et al. | |
| 2021/0388825 | A1 * | 12/2021 | Watt | B60K 1/00 |
| 2022/0252083 | A1 * | 8/2022 | Speichinger | F04D 29/605 |
| 2022/0252087 | A1 * | 8/2022 | Speichinger | F04B 1/12 |
| 2023/0043842 | A1 * | 2/2023 | Mickiewicz | F04B 53/16 |
| 2024/0191730 | A1 * | 6/2024 | Speichinger | F04C 2/34 |

FOREIGN PATENT DOCUMENTS

| | | | |
|---|---|---|---|
| AU | 2022323059 | A1 | 2/2024 |
| CN | 202597963 | U | 12/2012 |
| CN | 203430675 | U | 2/2014 |
| CN | 106678011 | A | 5/2017 |
| CN | 107859635 | A | 3/2018 |
| CN | 104295479 | B | 7/2018 |
| CN | 208203654 | U | 12/2018 |
| CN | 211853102 | U | 11/2020 |
| CN | 112145450 | A | 12/2020 |
| CN | 213018226 | U | 4/2021 |
| EP | 2059674 | B1 | 8/2018 |
| EP | 3539876 | A1 | 9/2019 |
| GB | 673718 | A | 6/1952 |
| GB | 2101220 | A | 1/1983 |
| GB | 2506148 | A | 12/2019 |
| RU | 2101586 | C1 | 1/1998 |
| RU | 2505713 | C1 | 1/2014 |
| SU | 1048129 | A1 | 10/1983 |
| TW | M559939 | U | 5/2018 |
| WO | 2015074440 | A1 | 5/2015 |

OTHER PUBLICATIONS

"International Application Serial No. PCT US2022 038260, International Search Report mailed Oct. 28, 2022", 4 pgs.
"International Application Serial No. PCT US2022 038260, Written Opinion mailed Oct. 28, 2022", 6 pgs.
"U.S. Appl. No. 17/171,416, Non Final Office Action mailed Feb. 24, 2023", 25 pgs.
"U.S. Appl. No. 17/171,473, Non Final Office Action mailed Apr. 13, 2023", 23 pgs.
"Texas Flange Product Catalog: Ver 5.00", [Online] Retrieved from the internet: https: web.archive.org web 20200523222344 https: www.texasflange.com wp-content uploads 2019 06 catalog-c-v5. pdf, (May 23, 2020), 80 pgs.
"U.S. Appl. No. 17/171,416, Response filed May 23, 2023 to Non Final Office Action mailed Feb. 24, 2023", 10 pgs.
"U.S. Appl. No. 17/393,685, Response filed Jun. 15, 2023 to Non Final Office Action mailed Mar. 15, 2023", 14 pgs.
"U.S. Appl. No. 17/171,416, Final Office Action mailed Jun. 22, 2023", 29 pgs.
"Flange Faces", saVRee 3D Interactive Media, [Online]. Retrieved from the Internet: https : savree.com enencyclopedia flange-faceshttps : web.archive.org web 20201125173751, (Nov. 25, 2020), 4 pgs.
"U.S. Appl. No. 17/171,473, Response filed Jul. 12, 2023 to Non Final Office Action mailed Apr. 13, 2023", 16 pgs.
"U.S. Appl. No. 17/393,685, Final Office Action mailed Jul. 6, 2023", 37 pgs.
"U.S. Appl. No. 17/171,416, Response filed Aug. 22, 2023 to Final Office Action mailed Jun. 22, 2023", 11 pgs.
"U.S. Appl. No. 17/393,685, Response filed Sep. 6, 2023 to Final Office Action mailed Jul. 6, 2023", 12 pgs.
"U.S. Appl. No. 17/393,685, Advisory Action mailed Sep. 14, 2023", 3 pgs.
"U.S. Appl. No. 17/171,416, Advisory Action mailed Sep. 7, 2023", 4 pgs.
"U.S. Appl. No. 17/393,685, Response filed Oct. 4, 2023 to Advisory Action mailed Sep. 14, 2023", 13 pgs.
"U.S. Appl. No. 17/171,416, Response filed Oct. 20, 2023 to Advisory Action mailed Sep. 7, 2023", 13 pgs.
"U.S. Appl. No. 17/171,473, Final Office Action mailed Oct. 3, 2023", 23 pgs.
"International Application Serial No. PCT US2022 015187, International Search Report and Written Opinion mailed May 3, 2022", 8 pgs.
"International Application Serial No. PCT US2022 015165, International Search Report and Written Opinion mailed May 31, 2022", 11 pgs.
"U.S. Appl. No. 17/171,416, Notice of Allowance mailed Dec. 5, 2023", 14 pgs.
"U.S. Appl. No. 17/171,416, Corrected Notice of Allowability mailed Dec. 12, 2023", 11 pgs.
"U.S. Appl. No. 17/171,416, Corrected Notice of Allowability mailed Feb. 9, 2024", 12 pgs.
"Complete Hydraulic Solutions Product Guide", [retrieved from internet on Aug. 3, 2024] URL:https: rapidhydraulics.com .au pdf southcott-components-product-sept-2018.pdf, (published on Sep. 2018), 1 pg.
Casappa Polaris, "Hydraulic Gear Pumps and Motors", (May 4, 2023), 92 pgs.
Rexroth Bosch Group, "Axial Piston Variable Pump", The Drive Control Company, RE 92050, (Oct. 2018), 76 pgs.
SKF, "UCF 212-36 Square Flanged Ball Bearing Units", [Online]. Retrieved from the Internet: URL: www.skf.com, (May 7, 2021), 4 pgs.
"U.S. Appl. No. 18/897,306, Non Final Office Action mailed Jul. 31, 2025", 24 pgs.
"U.S. Appl. No. 18/897,347, Non Final Office Action mailed Jul. 18, 2025", 20 pgs.

(56) References Cited

OTHER PUBLICATIONS

"U.S. Appl. No. 18/897,347, Response filed Oct. 20, 2025 to Non Final Office Action mailed Jul. 18, 2025", 10 pgs.
"U.S. Appl. No. 18/897,306, Response filed Oct. 31, 2025 to Non Final Office Action mailed Jul. 31, 2025", 11 pgs.
Written Opinion and International Search Report for Int'l. Patent Appln. No. PCT/US2025/045003, mailed Nov. 26, 2025 (13 pgs).

* cited by examiner

PUMP MOUNTING FLANGE

TECHNOLOGICAL FIELD

The present application relates generally to fluid management systems for work machines. More particularly, the present application relates to connections of pumps within a fluid management system, such as a hydraulic system, to motors or other mount equipment or devices. Still more particularly, the present application relates to robust torque-transferring flange connection for use in connecting a pump of a hydraulic system to a motor or other mount system of a work machine.

BACKGROUND

Connections between pumps and motors may be subject to continual operational forces. For example, a motor or engine may include a rotating shaft that extends out of the motor/engine housing and into the pump to drive the pump. That is, the rotating shaft may pass through the connection and the pump may resist motion of the shaft creating a torque between the motor/engine and the pump. Moreover, the pump may be mounted to the motor/engine housing or other power take-off housing and, in some cases, may not be otherwise supported. Accordingly, the inertial or other forces from internal motions and pressures within the pump and between the pump and other equipment and/or any external forces acting on the pump from connections or other piping or systems may be imparted to the connection between the pump and the motor or other power take-off system. While a pump has been described, sometimes the fluid flow may be reversed and the motive force may be the flowing fluid flowing into a fluid-powered motor to drive the fluid-powered motor, which, in turn, may drive a drive shaft and provide rotational power to the device it is connected to. In either case (i.e., pump or fluid-powered motor), it remains that the connection between the pump/fluid-powered motor and the housing may resist the forces generated by or imparted on the pump/fluid-powered motor.

With increasing demands on power and ongoing limitations on the size and/or pressures to reduce the size of components within engine compartments, standard connection designs are often not suitable to withstand the torsional and other forces experienced by pump connections.

U.S. Pat. No. 5,645,363 relates to a bearing cap with a power take-off unit that includes a body having a relatively large central opening formed through it. A first plurality of apertures is formed through the body of the bearing cap about the periphery of the body to secure it to the housing of the power take-off unit and for securing certain types of driven accessory mounting flanges to the bearing cap. Chinese Utility Model No.: 202597963 relates to a large oil pump discharge flange of an oil pump motor. U.S. Pat. No. 4,023,836 relates to a split flange retainer assembly adapted to engage the flanged head to a conduit for mounting the conduit to a bulkhead. Chinese Utility Model No.: 213018226 relates to a high-durability steel flange of a water pump. UK U.S. Pat. No. 2,506,148 relates to a flange assembly for connecting an inlet/outlet pipe to a pump.

SUMMARY

In one or more examples, a pump or fluid-powered motor for mounting at a mount location may include a housing defining an inlet and an outlet, internal pump components arranged within the housing and operably coupled to a drive shaft having a mechanical coupling mechanism adapted to engage a corresponding mechanical drive mechanism at the mount location. The pump or fluid-powered motor may also include a flange secured to the housing and adapted for securing the pump to the mount location. The flange may include a rectangular plate having a through bore and a substantially cylindrical pilot extending therefrom, defining a first diameter, and including a peripheral groove. The pilot may be configured for sealingly engaging a pilot recess or opening at the mount location. The flange may also include a plurality of bolt holes extending through the rectangular plate and arranged on a bolt circle with a second diameter larger than the first diameter. The second diameter may be approximately 240 mm and a distance from a top pair of the bolt holes to a bottom edge of the rectangular plate may be approximately 200 mm.

In one or more examples, a pump or fluid-powered motor for mounting at a mount location may include a housing defining an inlet and an outlet, internal pump components arranged within the housing and operably coupled to a drive shaft having a mechanical coupling mechanism adapted to engage a corresponding mechanical drive mechanism at the mount location. The pump or fluid-powered motor may also include a flange secured to the housing and adapted for securing the pump to the mount location. The flange may include a rectangular plate having a through bore and a substantially cylindrical pilot extending therefrom, defining a first diameter, and including a peripheral groove. The pilot may be configured for sealingly engaging a pilot recess or opening at the mount location. The flange may also include a plurality of bolt holes extending through the rectangular plate and arranged on a bolt circle with a second diameter larger than the first diameter. A ratio of the second diameter to the first diameter may range from 1.39 to 1.61.

DETAILED DESCRIPTION

Figure 1:
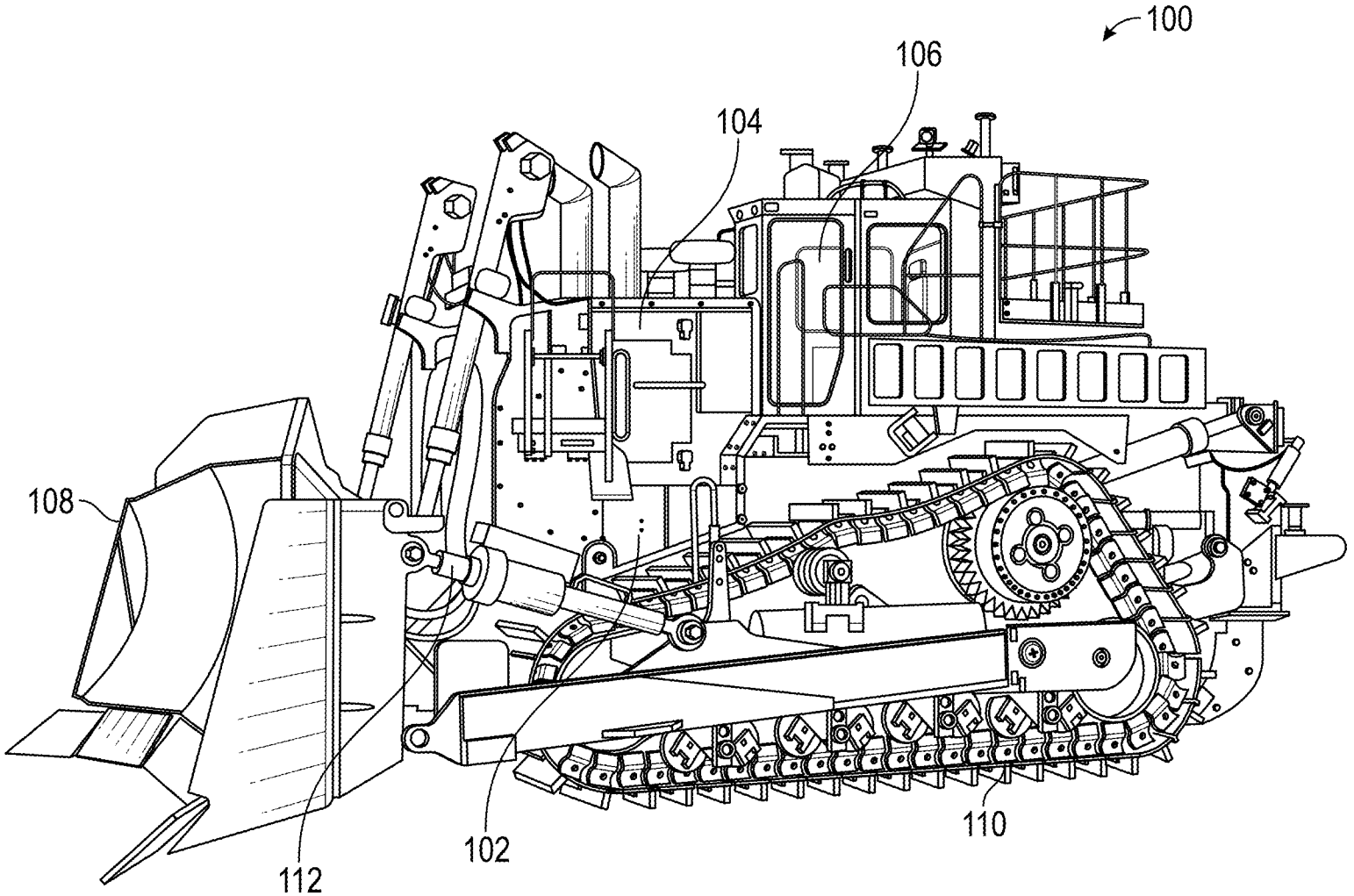
FIG. 1 is a perspective view of a work machine having a pump with a mounting flange, according to one or more examples.

FIG. 1 is a front perspective view of a work machine 100 in the form of a dozer. The work machine 100 may include a support frame 102 and a prime mover 104 arranged on the support frame 102 in addition to a cab or operator station 106 and a hydraulically controlled blade 108. The blade 108 may be operably coupled to the support frame 102 such as by a pivot connection and one or more actuators such as a hydraulic cylinder for adjusting the position of the blade relative to the ground and/or pivoting the blade angle relative to the ground. The work machine 100 may also include a ground engaging traction system such as one or more tracks 110. Still other features of the work machine 100 may be provided and while a dozer has been provided as an example, still other types of work machines with a pump/motor mounting flange according to the present application may be provided. For example, a work machine may include an excavator, haul truck, front-end loader, compactor, rotary mixer, cold planer, paving machine, or another type of work machine.

The work machine 100 may include a hydraulic system operably coupled to the prime mover 104 to provide power to the hydraulic system and/or the hydraulic system may provide fluid flow to provide motor power to one or more aspects of the work machine 100. The presently described mounting flange may be provided to operably couple a pump/fluid-powered motor of the hydraulic system to a shaft or other power take-off or delivery point on a work machine 100. In one or more examples, the hydraulic system may be used to operate one or more implements on the work machine 100. For example, with the excavator shown, the hydraulic system may be used to drive, or retract, hydraulic cylinders 112 to lift and/or tip the blade 108. In the case of other work machines 100, other implements may be operated using a hydraulic system.

Figure 2:
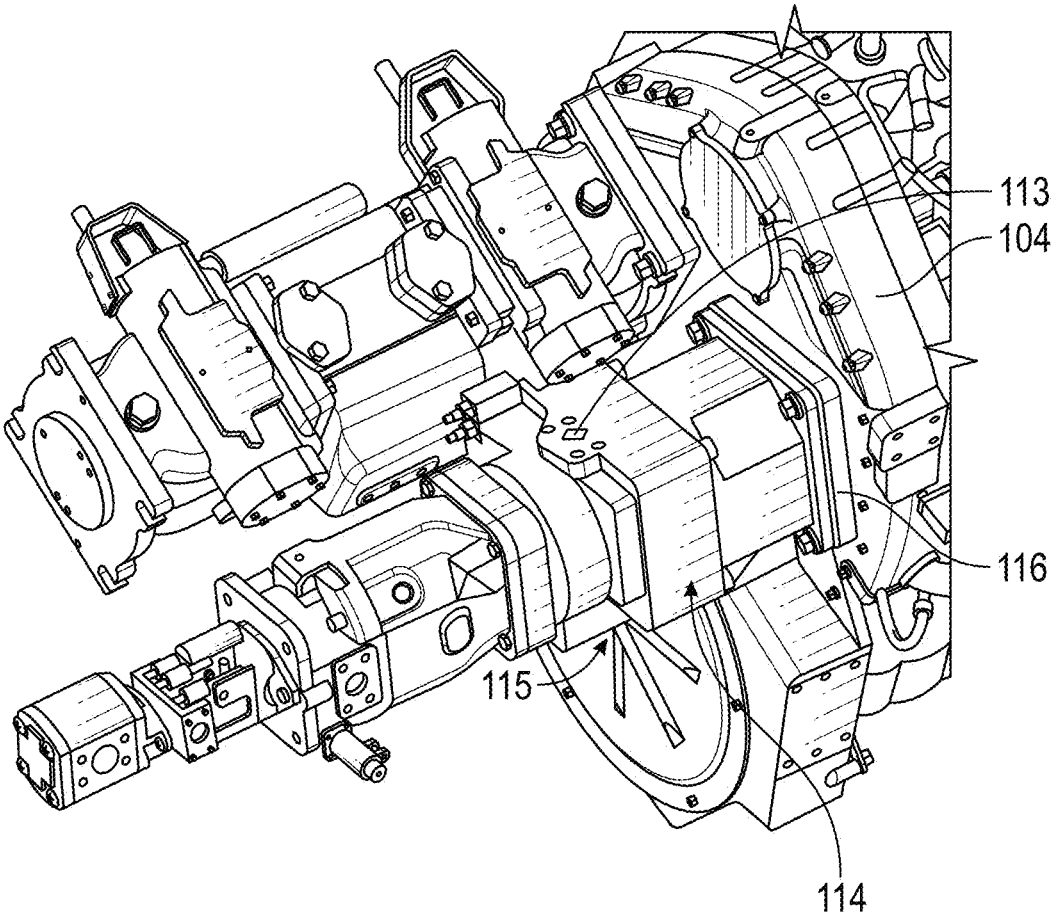
FIG. 2 is a perspective view of the pump with the mounting flange, according to one or more examples.

Referring now to FIG. 2, one example of a connection between a hydraulic pump 114 and a prime mover 104 is shown. As shown, the prime mover 104 may include a mount location 116 where a pump 114 may be mounted and, as such, may be held in a position where the internal mechanisms of the pump 114 are mechanically coupled to mechanical mechanisms of the prime mover 104. In one or more examples, the prime mover 104 may include a power shaft with a socket at the mount location 116 and a spline shaft may extend from the pump 114 into the socket of the mount location 116. Alternatively, the opposite system may be provided where an exposed rotating and splined shaft extends from the mount location 116 of the prime mover 104 and a splined socket may be provided on the pump 114 such that the shaft of the prime mover 104 engages with the socket to transfer rotation from the shaft to the pump. Still other engagement mechanisms or rotational power couplings may be provided. In one or more examples, a seal or seals may be provided around the rotational power coupling to maintain pressurized lubrication within the pump and/or with the prime mover. Moreover, while a splined connection has been described, a keyway and key slot system, a through rod/pin, or other rotational power transfer mechanism may be provided.

It is to be appreciated that while a prime mover 104 with a mount location for mounting of the pump 114 has been described, the opposite situation may be provided as well. That, is the pump 114 may, instead, be a fluid-powered motor that receives flowing fluid that drives the fluid-powered motor and the fluid-powered motor may provide rotational power via a shaft to a connected device or system. For purpose of simplicity, a pump 114 will be referenced throughout, but it is to be understood that such pump 114 may also be a fluid-powered motor. Moreover, and for similar reasons, a power-take off location 116 will be referred to, more generally, hereafter as a mount location 116. However, it is to be understood that where a mount location 116 is referenced, this could just as well be a power receiving location or, more generally, a mount location 116.

Within the prime mover 104, rotational power may be provided to the socket or shaft of the mount location 116 in one or more ways. For example, the socket or shaft may include a direct drive where operation of the prime mover 104 causes rotation of the socket or shaft. This may be in the form of a geared connection to a primary output shaft of the prime mover 104 or a belt driven system may be provided. In other cases, a clutch or other selective engagement system may be provided allowing for selective operation of the mount, or power receiving, socket or shaft by selectively engaging the primary output shaft or belt/pully system thereof. In one or more examples, a transmission may be provided allowing for selective relative speeds and torques to be provided or received to/from the mount, or power receiving, socket or shaft. Still other approaches to providing power to, or receiving power from, the mount, or power receiving, socket, shaft, or other power transfer element of the mount location may be provided.

With continued reference to FIG. 2, one example of a mount location 116 is shown. The mount location 116 may include one or more coupling features for securing the pump 114 to the mount location 116. The coupling features may be configured to interface with coupling features on the pump 114 to secure the pump to the mount location 116 of the prime mover 104 or other component. In one or more examples, the coupling features may include threaded bores that extend into the housing or other mounting feature of the prime mover 104 or other component. The bores may be adapted to receive bolts that extend through a flange on the pump 114 and into the threaded bores to secure the pump 114. Alternatively or additionally, the coupling feature may include threaded studs that extend outward from the mount location 116 and may be adapted to engage bolt holes on a flange of a pump where a nut or other fastener may be used to secure the flange to the threaded studs. The threaded bores, the threaded studs, or both, as the case may be, may be arranged in a pattern adapted to match a bolt hole pattern, or a portion thereof, on the flange of the pump 114.

The coupling feature of the mount location 116 may also include a pilot recess or opening configured to receive a pilot 120 of the pump flange 122 to provide for alignment of the pump 114. The pilot recess may also be configured, in conjunction with the pilot 120, for sealing the interface between the pump 114 and the mount location 116. The pilot 120 of the pump flange 122 is discussed in more detail below. The pilot recess or opening at the mount location 116 may have a shape matching that of the pilot 120 and slightly larger than the pilot 120 to receive the pilot 120 in nested fashion and engage a seal 124 arranged in a groove 126 of the pilot 120. In one or more examples, the pilot recess or opening may be a circular recess or opening having a diameter slightly larger than the pilot 120 on the pump flange 122. For example, the recess or opening diameter may range from approximately 160 mm to 163 mm or from approximately 161 mm to 162.5 mm or a diameter of 161.94 mm may be provided. In the case of a recess rather than an opening, the recess may have a depth adapted to fully receive the pilot (e.g., without the pilot bottoming out in the recess). That is, the recess depth may be slightly larger than the pilot length 128 of the pilot 120. In one or more examples, the depth of the recess may range from approximately 12 mm to 15 mm.

It is to be appreciated that while a pilot recess has been described where a seal is provided on the side of the pilot of the pump to seal against the radially inward facing face of the recess, other approaches may also be used. For example, a seal recess may be provided at the mount location where the seal recess is adapted to receive an O-ring or seal that is configured to seal against the face of the flange. Still other approaches to sealing the joint between the pump flange and the mount location may also be provided.

A pump 114 may be secured to the mount location 116 and may be powered by the socket or shaft of the mount location 116. That is, as mentioned above, a powered splined socket or keyed socket or shaft may be provided at the mount location 116, which may be engaged by a splined or keyed shaft or socket 118 (e.g., see FIG. 4) of the pump 114 to provide rotational power to the pump 114. The pump 114 may include an exterior housing from which the shaft extends or in which a socket is arranged. The pump 114 may be designed to draw hydraulic fluid in through an inlet 113 and expel hydraulic fluid out through an outlet 115 for communication to implements of the machine such as hydraulic cylinders, hydraulic motors, etc. Alternatively, and as mentioned, the pump 114 may be in the form of a fluid-powered motor that receives pressurized fluid through an inlet 113 that drives the internal components of the pump and exits through an outlet 115. Driving of the internal components with the pressurized fluid may turn the drive shaft to deliver resistance or rotational power to the connected component rather than receive rotational power from the connected component.

In one or more examples, the pump 114 may be an axial piston pump. The piston pump may include internal components such as a plurality of cylinder/piston systems arranged within a barrel. The piston/cylinder systems may be operable in series by rotation of the barrel relative to a swash plate. That is, the drive shaft may be connected to the barrel and may cause the barrel to rotate. As the barrel rotates relative to the swash plate, the angle of the swash plate may cause the pistons to alternately retract and then extend to draw in fluid and then eject the fluid from the pump. The swash plate may have an adjustable angle to control the resulting volume of fluid flow from the pump 114. The axial piston pump may also operate in reverse where fluid flows into the pump to drive the piston and generate rotational power.

In other examples, the pump 114 may be a gear pump. For example, a gear pump may include internal components such as a pair of internal intermeshing gears arranged in a cavity that cooperate in their rotation to draw in fluid from one side and eject fluid out the other side or, in the case of a motor, receive fluid in one side and release fluid out the other side. The inlet/outlet ports may be arranged on opposing sides of the cavity to take in and eject fluid, respectively. Alternatively, the inlet/outlet ports may be arranged on a same side. In one or more examples, the gear pump/motor may include a drive gear supported and driven by the drive shaft that extends out of the housing. A follower gear may be supported on an idler shaft. In the case of a pump, the follower gear may receive power by meshing with the drive gear. In the case of a motor, both the drive gear and the follower gear may receive power from the flowing fluid and the drive gear may deliver the rotational power to drive the drive shaft. Each of the drive shaft and the idler shaft may be supported by bearings that allow for generally free rotation of the shafts and the gears arranged thereon.

It is to be understood that the internal components of the pump may vary from this detailed description and include other types of pumps including rotational impeller type pumps, as well as other types of axial piston pumps, gear pumps, etc. In any case, for purposes of securing the pump 114 to the mount location 116 and to manage the torsional and other forces between the pump 114 and the mount location 116, the pump 114 may include an attachment flange 122.

Figure 3:
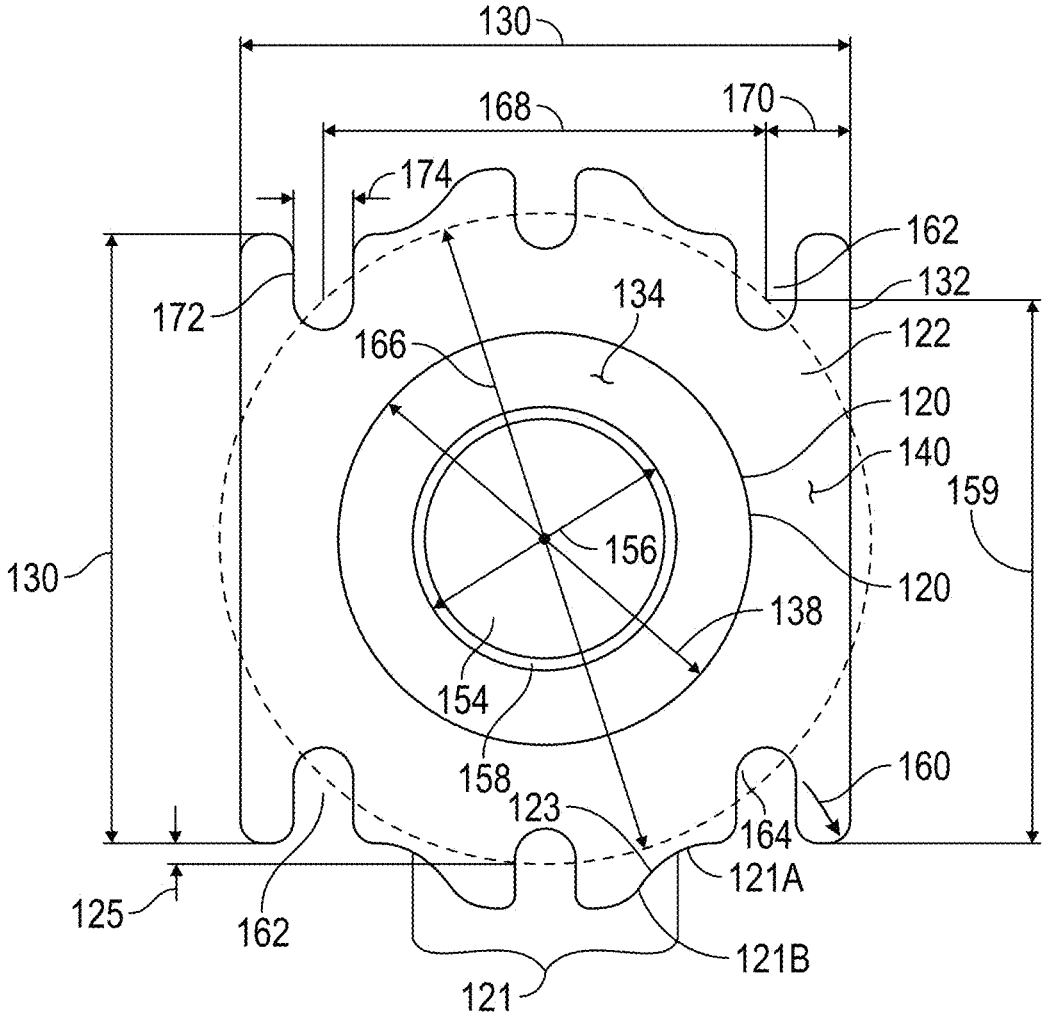
FIG. 3 is a front view of the mounting flange of FIG. 2, according to one or more examples.

As shown in FIGS. 3, the attachment flange 122 of the pump may be a generally rectangular or square flange having a width/length 130 ranging from approximately 220 mm to 240 mm or from approximately 230 mm to 234 mm or a width/length may be approximately 232 mm. As noted, the flange 122 may be rectangular or square and, as such, the width/length 130 might not be the same (e.g., rectangular) or the width/length 130 may be the same (e.g., square). The flange 122 may include radiused corners 132 having a radius 160 ranging from approximately 2 mm to 10 mm or from approximately 5 mm to 7 mm or a radius of 6 mm may be provided. The flange 122 may have a thickness ranging from approximately 20 mm to 30 mm or from approximately 22 mm to 26 mm, or a thickness of approximately 24 mm may be provided. As shown in FIG. 3, in one or more examples, the flange 122 may include bolt holes 162 for receiving fasteners to secure the flange 122 and pump 114 to the mount location 116. The bolt holes may be sized to receive suitable fasteners and may include a diameter ranging from approximately 16 mm to approximately 28 mm or from approximately 20 mm to approximately 24 mm or a diameter of approximately 22 mm may be used.

Figure 4:
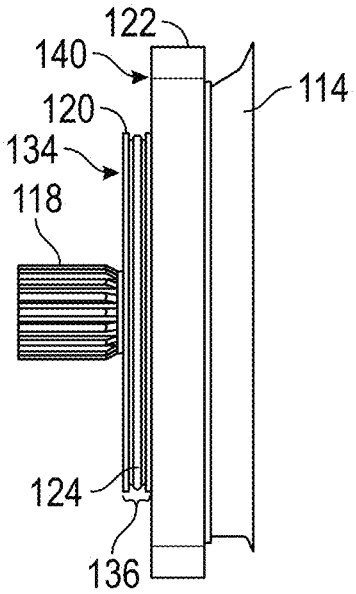
FIG. 4 is a side view of the mounting flange of FIGS. 2 and 3 affixed to the pump, according to one or more examples.

As mentioned, the flange 122 may include a pilot 120 for engaging a pilot recess at the mount location 116. As shown in FIGS. 3 and 4, the pilot 120 may include a raised element on the surface of the flange 122 adapted for arrangement in the pilot recess or opening of the mount location 116. The pilot 120 may have a generally cylindrical shape having a circular end face 134 and a cylindrical sidewall 136 defined by a pilot diameter 138 and a pilot length 128 extending away from a face 140 of the flange 122. The diameter 138 of the pilot 120 may range from approximately 155 mm to 165 mm, or from approximately 158 mm to 162 mm or the pilot 120 may have a diameter 138 of approximately 160 mm. The pilot length 128 may range from approximately 10 mm to 14 mm or have a length of approximately 12 mm or 13 mm or 12.7 mm. The intersection between the cylindrical sidewall 136 and the end face 134 of the pilot 120 may be chamfered and have dimensions of approximately 1.2 mm by 0.6 mm defining a 30 degree leading chamfer, for example. While described as cylindrical, alternatively, the pilot 120 may be rectangular, square, triangular, star-shaped, cross-shaped, or another shape may be provided.

The pilot 120 may include a pilot groove 126 configured for receiving a seal 124. In one or more examples, the seal 124 may include a single seal or it may include a primary seal and a backup seal depending on the pressure of the system. The groove 126 may be a peripherally extending groove 126 arranged on the cylindrical sidewall 136 and may have a width 142 ranging from approximately 4 mm to approximately 6 mm or from 4.5 mm to approximately 5.5 mm, or a groove width 142 of approximately 5.2 mm may be provided. As shown in FIG. 4 and more closely in FIG. 5, the groove may be positioned approximately ½ of the way along the sidewall 136 from the flange 122 to the circular end face 134. More particularly, and working from the chamfered end, the distance 144 from the end of the pilot 120 to the groove 126 may be approximately 3.5 mm, the groove width 142 may be approximately 5.2 mm, and the remaining distance 146 from the groove 126 to the flange 122 may be approximately 4 mm. Where a different groove width 142 is provided as discussed above, the general center of the groove 126 may be unchanged and, as such, the distance 144 from the chamfered end to the groove 126 and the remaining distance 146 to the flange 122 may fluctuate accordingly. Alternatively, the distance 144 from the chamfered end or the distance 146 from the flange 122 may be maintained and the changes in the groove width 142 may be absorbed by the other of the two dimensions. As mentioned, where high-pressure conditions are present, the seal may include a primary seal and a backup seal or backup ring arranged behind the primary seal. In these cases, the groove width 142 may be increased to accommodate the increased width of the seal components.

Figure 5:
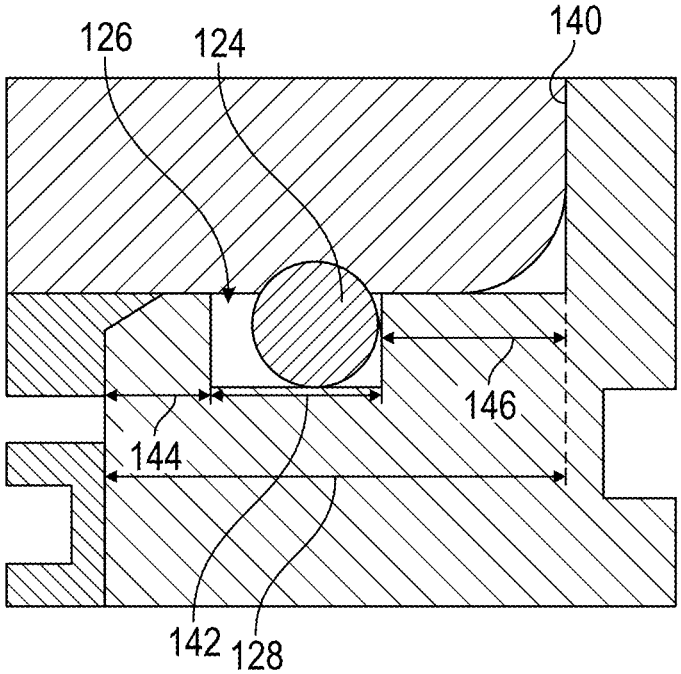
FIG. 5 is a close-up cross-sectional view of a portion of a pilot of the flange of FIGS. 2-4, according to one or more examples.
Figure 6:
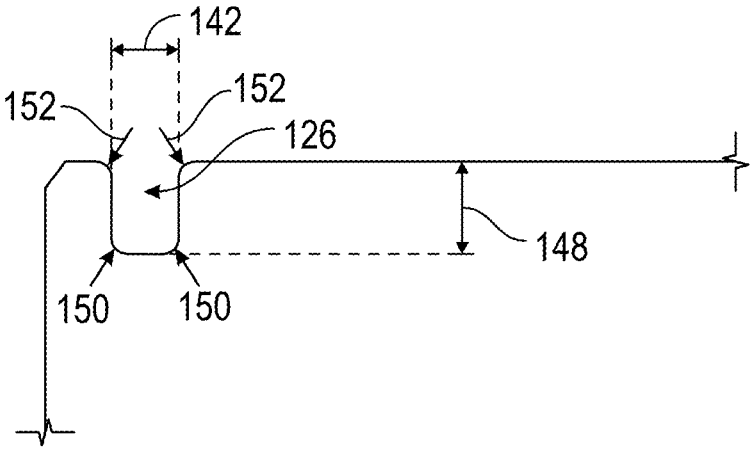
FIG. 6 is a close-up detail of a seal groove on the pilot.

As shown in FIG. 4 and in more detail in FIGS. 5 and 6, the groove 126 may be a generally rectangular groove when viewed in cross-section. The groove may have a depth 148 ranging from approximately 2 mm to approximately 4 mm or from 2.5 mm to 3.5 mm, or a groove depth 148 of approximately 3.15 mm may be provided. The inner corners 150 of the generally rectangular groove 126 may have a radius of approximately 0.5 mm and the outer corners 152 of the groove 126 may be chamfered or have a radius of approximately 0.2 mm. Still other groove depths 148, widths 142, and corner details may be provided. As shown in FIG. 5, a seal 124 such as an O-ring seal may be provided in the groove 126 where the cross-sectional diameter of the O-ring seal is larger than the groove depth 148 so as to protrude from the groove 126 when placed therein.

As shown in FIG. 3, the flange 122 may include a through bore 154 arranged within the boundary of the pilot 120 to allow the shaft of the pump 114 to extend out of the pump for engagement with the socket at the mount location 116 or to allow entry of a shaft from the mount location to pass within the housing of the pump 114. The through bore 154 may have a diameter 156 ranging from approximately 50 mm to 150 mm or approximately 70 mm to 110 mm or a diameter of approximately 90 mm may be provided. A chamfered or notched transition 158 may be provided along the peripheral edge of the through bore 154 to transition from circular face 134 of the pilot 120 to the through bore 154.

In one or more examples, and as shown in FIG. 3, the flange 122 may define an X-Y-Z coordinate system where the Z-axis extends along a centerline of the power providing or receiving shaft. The X-axis may extend laterally across the face of the flange and the Y-axis may extend up/down across the face of the flange. All axes may pass through an origin arranged in the plane of the face of the flange 122 along the Z-axis.

As shown in FIG. 3, the flange 122 may include a plurality of bolt holes 162 for securing the pump 114 to the mount location 116. The bolt holes 162 may be arranged to align with one or more portions of the coupling feature of the mount location 116. That is, for example, where threaded bores or studs are provided at the mount location 116, the flange 122 may include one or more bolt holes 162 that align with these aspects of the coupling feature. In one or more examples, the plurality of bolt holes 162 may be arranged on a bolt circle 164 having a diameter 166 ranging from approximately 230 mm to 250 mm or from approximately 235 mm to 245 mm, or a bolt circle diameter 166 of 240.41 mm may be provided. Still further, and as shown, all or a portion of the plurality of bolt holes 162 may be arranged in a rectangular or square pattern. In one or more examples, the pattern may be a square pattern where the bolt spacing 168 from one bolt hole 162 to an adjacent bolt hole 162 ranges from approximately 165 mm to 175 mm or from approximately 168 mm to 172 mm or a spacing of approximately 170 mm may be provided. It is to be appreciated that with respect to the torsional forces of the pump, the arrangement of the several bolt holes 162 on a same bolt circle 164 may cause all of the bolts arranged in the bolt holes 162 to experience a generally equally divided amount of load from the torsional force. That is, where 4 bolts are provided, each bolt may experience ¼ of the torsional load. Where 6 bolts are provided, each bolt may experience ⅙ of the torsional load. Loads that vary from this equally divided condition may also be carried by the bolts.

The bolt holes 162 may have a diameter adapted to receive a bolt sufficiently large to carry the torsional and other loading. In one or more examples, the bolt holes 162 may have a diameter adapted for receiving an M20 bolt. The bolt holes 162 may be spaced inward from an outer edge of the flange by an edge distance 170 of approximately 31 mm. Still other edge distances may be provided. In one or more examples, for purposes of installation, the bolt hole 162 may extend through an outer edge of the flange 122. That is, for example, as shown in FIG. 3, a slot 172 may extend from the bolt hole 162 through the edge of the flange 122. In one or more examples, the bolt holes 162 may be arranged generally in the corners of the flange 122 and the slot 172 may be arranged vertically to extend from the bolt hole 162 through upper/lower side or edge of the flange 122. That is, in one or more examples, the slot 172 may have a longitudinal centerline that passes through the center of the bolt hole 162 and passes vertically, parallel to the left and right sides of the flange, through the upper or lower side of the flange 122, whichever is nearest the respective bolt hole 162. The slot 172 may have a width 174 that is the same as the bolt hole diameter. In one or more examples, the bolt hole diameter and/or slot width may range from approximately 18 mm to approximately 26 mm or from approximately 20 mm to approximately 24 mm or a bolt hole diameter and/or slot width of approximately 22 mm may be provided. In one or more examples, a chamfered or radiused surface may be provide where the side wall of the slot meets the outer peripheral edge of the flange.

The pump 114 may be mounted to the mount location 116 with bolts, studs, or other fasteners. In one or more examples, a bolt size of M20 may be provided.

In one or more examples, while the flange may be generally rectangular or square, a pair of ears, tabs, or lugs, 121 may extend from respective upper and lower sides of the flange 122. As shown, the ears 121 may be substantially contoured meaning a curved surface 121A is provided that diverges gradually from the top/bottom edge of the flange and extends to an inflection point 123 whereafter another curved surface 121B gradually returns to being parallel to the top/bottom edge from which it originally diverged. The curved surfaces 121A/B may be radiused surfaces or other types of curves may be provided. In one or more examples, the diverging curve 121A may be the same or similar to the return curve 121B such that the inflection point is about ½ way along the length of the ear or tab from where it diverges from the top/bottom edge to where it returns to being parallel to the top/bottom edge.

The ears 121 may be symmetrical about a line extending generally orthogonal to the respective top/bottom edge from which the ear 121 extends. The ears 121 may also be arranged halfway across the width of the flange. In one or more examples, the ears 121 may include a bolt hole 162 that is the same or similar to the other bolt holes 162 in the flange. As shown in FIG. 3, in one or more examples, the bolt hole 162 in the ear 121 may have a center point that is offset from the top/bottom edge of the flange by an offset distance 125. The bolt hole 162 in the ear may be located to fall on the bolt circle 164 defined by the four bolt holes 162 in the corners of the flange 122 and the offset distance may be based on locating the bolt hole 162 in the ear 121 and on the bolt circle 164. In one or more examples, the bolt hole 162 may include a slot extending through an outboard edge of the ear 121. The slot 172 may have a width matching that of the diameter of the bolt hole 162. In one or more examples, the longitudinal centerline of the slot 172 may be generally orthogonal to the top/bottom edge of the flange 122 from which the ear 121 extends and may also coincide with the line of symmetry of the ear 121. Where a slot is not provided, the bolt hole may, nonetheless, be arranged on the line of symmetry of the ear 121. In other examples, the bolt hole 162 and/or slot 172 may not be arranged on the line of symmetry and may be offset to one side or the other. In one or more examples, the slot 172 may have chamfered or radiused corners where the slot extends through the outer peripheral surface of the ear 121.

The ear 121 may have an overall length ranging from approximately 40 mm to approximately 120 mm or from approximately 90 mm to approximately 110 mm, or a length of approximately 100 mm may be provided. The ear may also have a width measured by the distance the ear extends away from the top/bottom edge. The width may range from approximately 15 mm to approximately 30 mm or from approximately 18 mm to approximately 22 mm or a width of 20 mm may be provided.

It is to be appreciated that while a mount location such as on an engine and a flange on a pump have been described, the pump or fluid-powered motor may be coupled to another pump or another pump may be coupled to it. Accordingly, while the pump has been described as having an attachment flange, the pump or fluid-powered motor may also include a mount location on an opposite end for attachment of another pump.

INDUSTRIAL APPLICABILITY

Several advantages of the above-described design give rise to its industrial applicability. For example, the particular sizes and spacings of the several components making up the connection between the pump and the mount location may provide for a strong, torque resisting connection not provided by standard designs. The particular sizes and relationships between the sizes may provide for a connection and torque resistance suitable for a wide range of connections and, in particular, pump connections such as axial piston pump connections. In one or more examples, the present connection design may be suitable for pumps or combinations of pumps generating torques ranging from approximately 1700 Nm to approximately 1800 Nm or from approximately 1710 Nm to approximately 1775 Nm, or the design may be suitable for pumps or combinations of pumps generating a torque of approximately 1713 Nm or approximately 1771 Nm.

Figure 7:
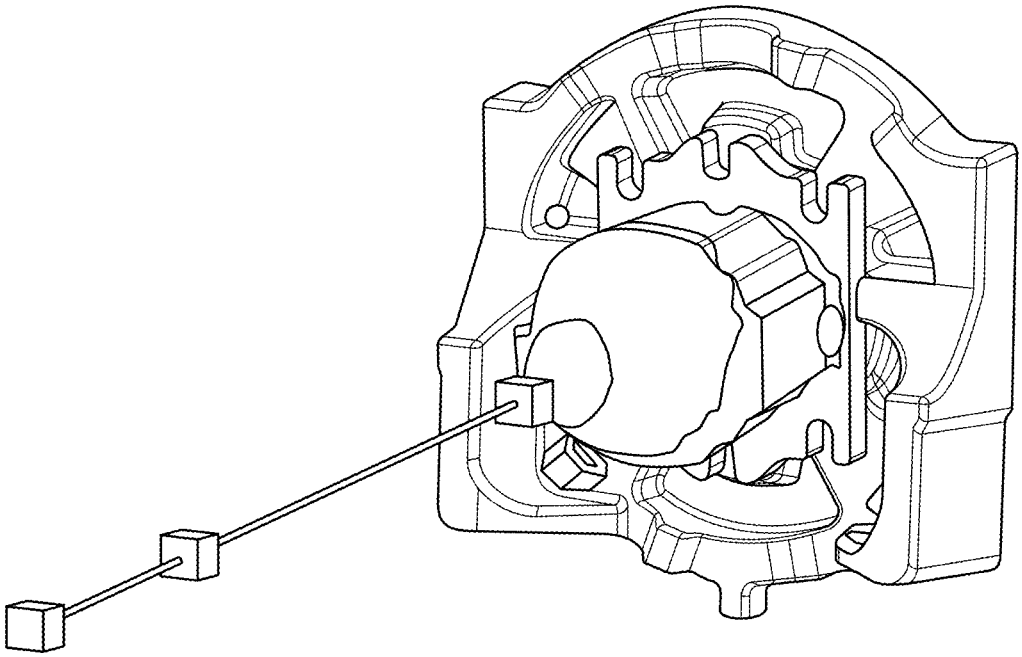
FIG. 7 is a loading diagram of the mounting flange, according to one or more examples.
Figure 8B:
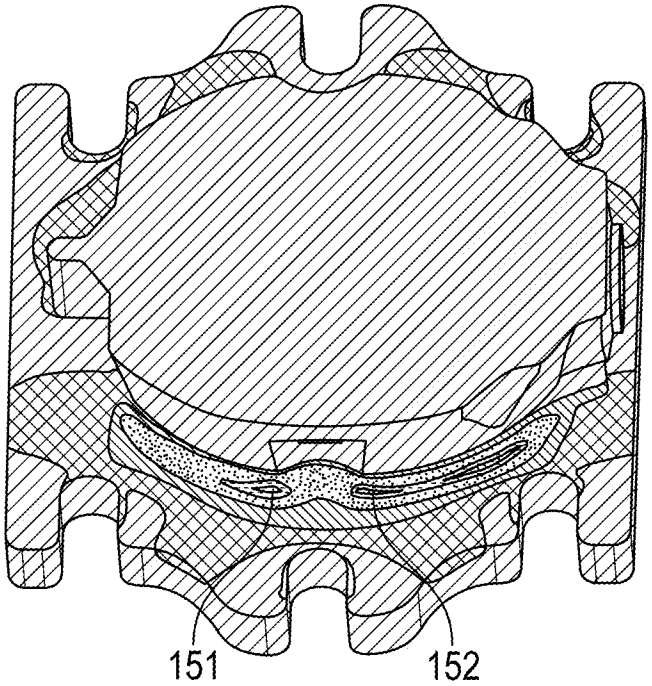
FIGS. 8A and 8B are stress diagrams showing the stresses resulting from the loading shown in FIG. 7 and including a view of the topside stresses and the bottom side stresses, respectively.
Figure 8A:
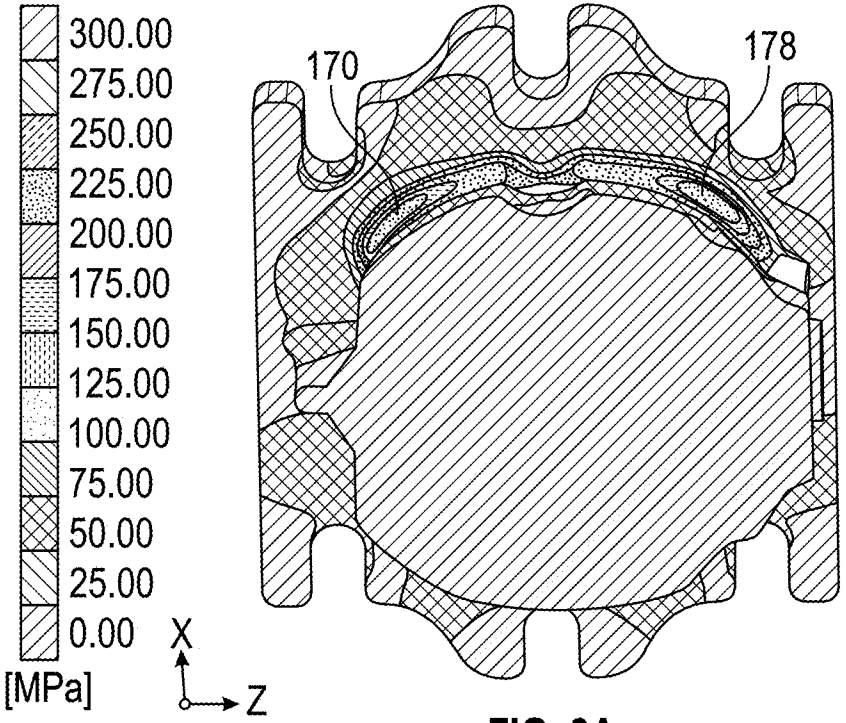
Figure 9:
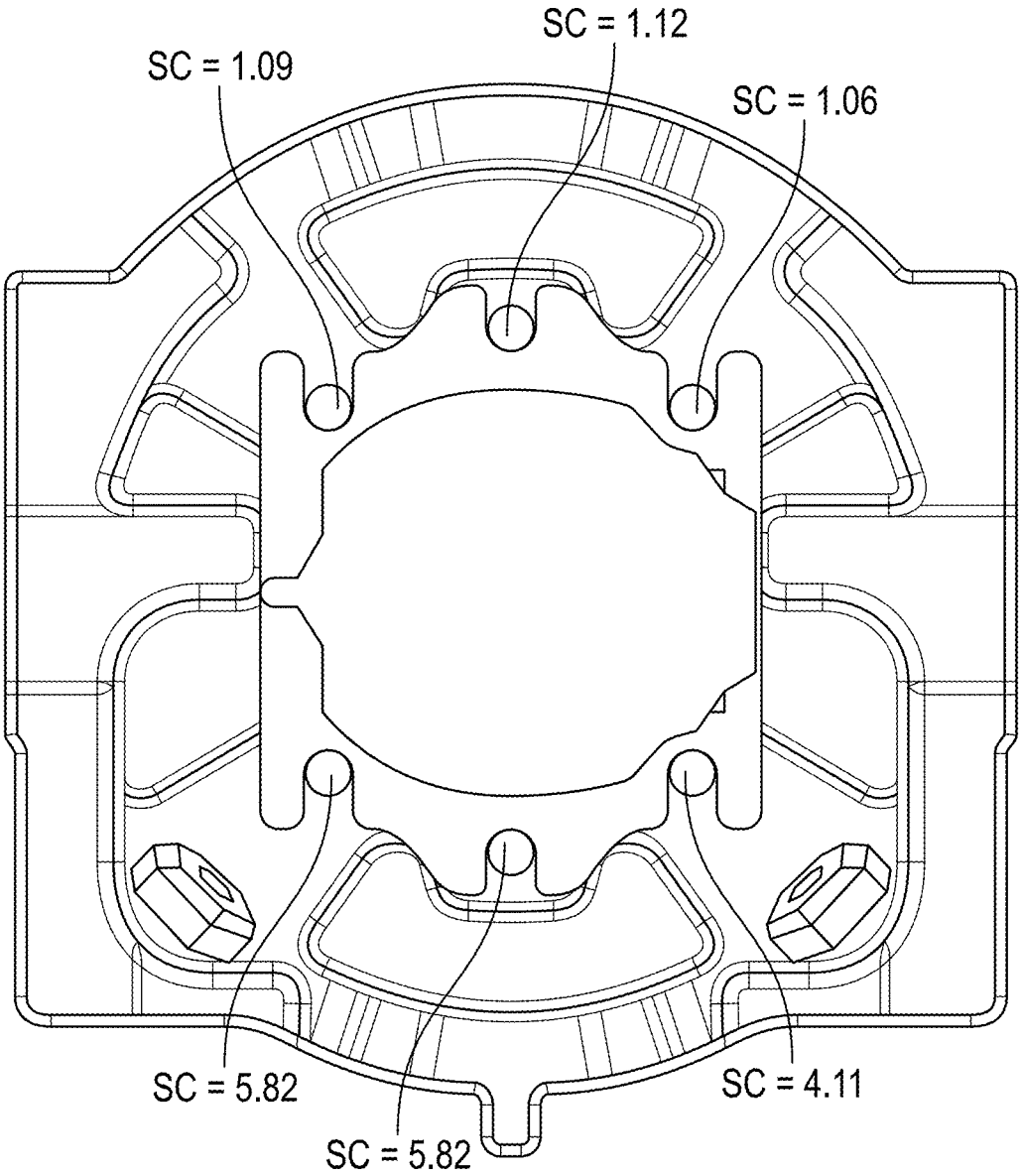
FIG. 9 is a bolt shear diagram, according to one or more examples.

As shown in FIG. 7, the present flange may be used for supporting one or more pumps at the mount location. In the diagram of FIG. 7, a loading example is provided where the center of gravity of each pump is applied in a downward direction. Moreover, when the pumps are operating, the torsional forces from the operation may also be imparted on the connection between the pumps and the mount location. For example, the pump furthest from the connection may generate a torque of approximately 179 Nm, while the middle pump generates a torque of 796 Nm, and the pump nearest the connection generates a torque of 796 Nm for a total torque of 1771 Nm. FIGS. 8A and 8B show the resulting stresses in the flange. As shown, while a large portion of the flange remains at low stress, stress concentrations may occur at the top/bottom side of the interface between the pump and the flange (e.g., due to the weight of the pumps pulling on the top and pushing on the bottom). In one or more examples, these stresses may be approximately 170-178 MPa near the top side of the pump and 151-152 MPa near the bottom side of the pump. Moreover, with reference to FIG. 9, the shear capacity of the bottom side bolts may range from approximately 2.5 to 3.3. However, the shear capacity of the top side bolts may be approximately 1.0 and may range from approximately 1.00 to approximately 5.82. Accordingly, the geometry of the flange and including the bolt spacings provided result in bolt loads that only barely meet the acceptable shear capacity of 1.0. This shows that variation from the geometry provided such as using a smaller bolt circle will likely cause the bolts to fail. Moreover, as discussed, increasing the bolt spacing has become unacceptable due to space constraints. It is to be appreciated that the dimensions relating to the shear in the bolts may include the bolt circle diameter because the larger the bolt circle, the more leverage the bolts have to resist torque. Additionally, increasing the distance 159 from the bottom of the flange to the top set of bolts may also provide to reduce the forces in the bolts due to providing more leverage of the bolts against the weight of the pumps. In the present example, the bolt circle diameter may range from approximately 235 mm to approximately 245 mm or approximately 240 mm while the distance 159 from the bottom of the flange to the top pair of bolts may range from approximately 195 mm to approximately 205 mm or the distance 159 may be approximately 201 mm or 200 mm. Accordingly, this combination of dimensions is important to allowing for the particular flange design, which is small enough to meet space constraints, to also resist the forces imparted thereon.

Still further, for example, the bolt hole spacing on the flange has been said to range from approximately 165 mm to 175 mm and the pilot diameter on the flange has been said to range from approximately 155 mm to 165 mm. The relationship between these two elements establishes a unique value that accommodates pump size, sealing requirements, bolt spacing and edge distances, and torque loading requirements. In one or more examples, the ratio of the bolt hole spacing to the pilot diameter may range from approximately 1.00 to 1.13 or from approximately 1.03 to 1.09 or a ratio of 1.06 may be provided.

In another example, the ratio of the bolt circle to the pilot diameter may establish a unique value that accommodates pump size, sealing requirements, bolt spacing and edge distances, and torque loading requirements. In one or more examples, the ratio of the bolt circle diameter to the pilot diameter may range from approximately 1.39 to 1.61 or from approximately 1.44 to 1.56 or a ratio of 1.5 may be provided.

The above detailed description is intended to be illustrative, and not restrictive. The scope of the disclosure should, therefore, be determined with references to the appended claims, along with the full scope of equivalents to which such claims are entitled.

What is claimed is:

1. A pump or fluid-powered motor for mounting at a mount location, comprising:

a housing defining an inlet and an outlet;

internal pump components arranged within the housing and operably coupled to a drive shaft having a mechanical coupling mechanism adapted to engage a corresponding mechanical drive mechanism at the mount location; and a flange secured to the housing and adapted for securing the pump to the mount location, the flange comprising a rectangular plate having at least two parallel sides and two other sides and having a through bore and a substantially cylindrical pilot extending therefrom, defining a first diameter, and including a peripheral groove, the pilot configured for sealingly engaging a pilot recess or opening at the mount location, the flange further comprising a pair of ears on opposing sides of the flange each extending from a respective one of the other sides and a plurality of bolt holes extending through the rectangular plate, forming slots extending through a first edge of the flange, and arranged on a bolt circle with a second diameter larger than the first diameter, wherein the second diameter is from 235 mm to 245 mm and a distance from a top pair of the bolt holes to a bottom edge of the rectangular plate is 195 mm to 205 mm and the slots extend parallel to a second edge of the flange.

2. The pump or fluid powered motor of claim 1, wherein the plurality of bolt holes comprises four bolt holes arranged in a rectangular pattern and two bolt holes arranged in respective ones of the pair of ears.

3. The pump or fluid powered motor of claim 1, wherein the peripheral groove has a width from 4 mm to 6 mm and a depth from 2 mm to 4 mm.

4. The pump or fluid powered motor of claim 3, wherein an inner edge of the peripheral groove is spaced from a face of the flange by a distance of approximately 4 mm.

5. The pump or fluid powered motor of claim 1, wherein the pilot has a pilot length from 10 mm to 14 mm.

6. The pump or fluid powered motor of claim 5, wherein the pilot has a chamfered end.

7. The pump or fluid powered motor of claim 6, wherein the chamfered end is spaced from the peripheral groove by a distance of approximately 2.67 mm.

8. The pump or fluid powered motor of claim 1, wherein the pump is an axial piston pump delivering a torque to the flange connection ranging from 1700 Nm to 1800 Nm.

9. A pump or fluid-powered motor for mounting at a mount location, comprising:

a housing defining an inlet and an outlet;

internal pump components arranged within the housing and operably coupled to a drive shaft having a mechanical coupling mechanism adapted to engage a corresponding mechanical drive mechanism at the mount location; and a flange secured to the housing and adapted for securing the pump to the mount location, the flange comprising a rectangular plate having at least two parallel sides and two other sides and having a through bore and a substantially cylindrical pilot extending therefrom, defining a first diameter, and including a peripheral groove, the pilot configured for sealingly engaging a pilot recess or opening at the mount location, the flange further comprising a pair of ears on opposing sides of the flange each extending from a respective one of the other sides and a plurality of bolt holes extending through the rectangular plate, forming slots extending through a first edge of the flange, and arranged on a bolt circle with a second diameter larger than the first diameter, wherein, the plurality of bolt holes have a spacing ranging from 165 mm to 175 mm and a ratio of the spacing to the first diameter is from 1.00 to 1.13 and the slots extend parallel a second edge of the flange.

10. The pump or fluid powered motor of claim 9, wherein the plurality of bolt holes comprises four bolt holes arranged in a rectangular pattern and two bolt holes arranged in respective ones of the pair of ears.

11. The pump or fluid powered motor of claim 9, wherein the peripheral groove has a width from 4 mm to 6 mm and a depth from 2 mm to 4 mm.

12. The pump or fluid powered motor of claim 9, wherein the pilot has a pilot length from 10 mm to 14 mm.

13. The pump or fluid powered motor of claim 9, wherein the pump is an axial piston pump delivering a torque to the flange connection ranging from 1700 Nm to 1800 Nm.

14. A pump or fluid-powered motor for mounting at a mount location, comprising:

a housing defining an inlet and an outlet;

internal pump components arranged within the housing and operably coupled to a drive shaft having a mechanical coupling mechanism adapted to engage a corresponding mechanical drive mechanism at the mount location; and a flange secured to the housing and adapted for securing the pump to the mount location, the flange comprising a rectangular plate having at least two parallel sides and two other sides and having a through bore and a substantially cylindrical pilot extending therefrom, defining a first diameter, and including a peripheral groove, the pilot configured for sealingly engaging a pilot recess or opening at the mount location, the flange further comprising a pair of ears on opposing sides of the flange each extending from a respective one of the other sides and a plurality of bolt holes extending through the rectangular plate, forming slots extending through a first edge of the flange, and arranged on a bolt circle with a second diameter larger than the first diameter, wherein a ratio of the second diameter to the first diameter is from 1.39 to 1.61 and the slots extend parallel to a second edge of the flange.

15. The pump or fluid powered motor of claim 14, wherein the plurality of bolt holes comprises four bolt holes arranged in a rectangular pattern and two bolt holes arranged in respective ones of the pair of ears.

16. The pump or fluid powered motor of claim 14, wherein the peripheral groove has a width from 4 mm to 6 mm and a depth from 2 mm to 4 mm.

17. The pump or fluid powered motor of claim 16, wherein an inner edge of the peripheral groove is spaced from a face of the flange by a distance of approximately 4 mm.

* * * * *